US005277388A

United States Patent [19]

Denaro

[11] Patent Number: 5,277,388

[45] Date of Patent: Jan. 11, 1994

[54] COLLAPSIBLE STAND

[76] Inventor: James Denaro, 543 Bedford St., Concord, Mass. 01742

[21] Appl. No.: 983,494

[22] Filed: Nov. 30, 1992

[51] Int. Cl.[5] ..... A47G 23/02

[52] U.S. Cl. ..... 248/152; 248/174; 206/45.25

[58] Field of Search ..... 248/152, 174, 459; 206/491, 45.21, 45.25, 45.26, 45.29; 211/130, 132, 135, 195

[56] References Cited

U.S. PATENT DOCUMENTS

| | | | |
|---|---|---|---|
| 1,086,690 | 2/1914 | Rosenberg | 248/174 |
| 1,594,848 | 8/1926 | Partem | 248/174 |
| 1,675,060 | 6/1928 | Simmons | 248/459 |
| 1,720,136 | 7/1929 | Neumann | 248/174 X |
| 2,005,816 | 6/1935 | Weiss | 206/45.21 |
| 2,654,173 | 10/1953 | Christenen et al. | 248/459 |
| 2,677,469 | 5/1954 | Ebert | 248/459 |
| 3,139,255 | 6/1964 | Palm | 248/152 |
| 3,705,681 | 12/1972 | Rossi et al. | 206/491 X |

*Primary Examiner*—Alvin C. Chin-Shue
*Assistant Examiner*—Korie H. Chan
*Attorney, Agent, or Firm*—John E. Toupal; Harold G. Jarcho

[57] ABSTRACT

A collapsible stand including a unitary sheet having a central portion; a pair of wing portions, one joined to each lateral edge of the central portion at a bendable joint; a pair of leg portions, one joined to a bottom edge of each wing portion and extending downwardly below a bottom edge of the central portion; a connecting portion extending upwardly from the central portion and joined thereto at a bendable joint; and a bottom portion joined to an upper edge of the connecting portion at a bendable joint. The bottom portion defines a pair of oppositely directed laterally projecting insert portions; and each of the leg portions defines a receptacle disposed to receive one of the insert portions with the wing portions bent forwardly into positions substantially perpendicular to the central portion, the connecting portion bent downwardly into a position substantially parallel to the central portion, and the bottom portion bent forwardly into a position extending transversely to the central portion. The unitary sheet can be quickly assembled into an object supporting stand.

20 Claims, 3 Drawing Sheets

COLLAPSIBLE STAND

BACKGROUND OF THE INVENTION

This invention relates generally to a collapsible stand and, more particularly, to a collapsible stand specifically suitable for supporting a radio control transmitter.

Radio control transmitters are used extensively by hobbiests to control the flight of model aircraft. Typically, such flights are made outdoors in an accessible open space such as a field, beach, shore or the like. While preparing an aircraft for flight, an operator generally will position his radio transmitter unit on the ground. Such action often results in an accumulation of dirt, sand or moisture that can damage the highly sensitive transmitter.

Various types of stands and holders have been developed for supporting diverse objects. Some such stands are collapsible so as to facilitate storage and handling. Examples of collapsible stands are disclosed in U.S. Pat. Nos. 2,591,170; 4,537,380; 3,164,256; 1,180,057; 4,880,194; 4,036,465; 2,787,086. However, prior collapsible stands fail to provide the low cost, ease of handling and configuration desirable for supporting a radio control transmitter during preparation of a model aircraft.

The object of this invention, therefore, is to provide an improved collapsible stand specifically suited for supporting a radio control transmitter unit.

SUMMARY OF THE INVENTION

The invention is a collapsible stand including a unitary sheet having a central portion; a pair of wing portions, one joined to each lateral edge of the central portion at a bendable joint; a pair of leg portions, one joined to a bottom edge of each wing portion and extending downwardly below a bottom edge of the central portion; a connecting portion extending upwardly from the central portion and joined thereto at a bendable joint; and a bottom portion joined to an upper edge of the connecting portion at a bendable joint. The bottom portion defines a pair of oppositely directed laterally projecting insert portions; and each of the leg portions defines a receptacle disposed to receive one of the insert portions with the wing portions bent forwardly into positions substantially perpendicular to the central portion, the connecting portion bent downwardly into a position substantially parallel to the central portion, and the bottom portion bent forwardly into a position extending transversely to the central portion. The unitary sheet can be quickly assembled into an object supporting stand.

According to one feature of the invention, each leg portion includes an extension disposed below the central portion and separated from the bottom edge thereof by a slot. The leg extensions enhance the stability of the stand.

According to another feature of the invention, after insertion of the insert portions into the leg receptacles, the bottom portion is inclined with respect to bottom edges of the leg portions upwardly from the central portion. This arrangement insures retention of an object in a slightly inclined orientation.

According to yet another feature of the invention, the unitary sheet further includes a waist portion joined to an upper edge of the bottom portion at a bendable joint and having laterally projecting waist tabs, and each leg portion further defines an opening disposed to receive one of the waist tabs with the inserts received by the receptacles and the waist portion bent downwardly into a position transverse to the bottom portion. This feature further enhances the stability of the stand.

According to a further feature of the invention, the unitary sheet further includes a front stop portion projecting downwardly from the waist portion and separated from the bottom portion by slots. The stop portion provides a surface for confining an object retained on the stand.

According to additional features of the invention, the central portion includes a pair of laterally disposed projections extending upwardly from joints between the central portion and the connecting portion and each projection is separated from the connecting portion by a slot and joined to one of the wing portions by a bendable joint. The projections form walls for confining an object retained on the stand.

According to yet another feature of the unitary sheet is an integrally molded plastic sheet. This feature reduces the cost of the stand.

According to a further feature, each bendable joint is a grooved joint. Bendable joints are easily and inexpensively formed by scoring the unitary sheet.

According to still further features of the invention, each receptacle is an elongated slot, each insert comprises a pair of laterally projecting spaced apart tabs, and each leg portion has a bottom edge for engaging a supporting surface and disposed at an angle to an elongated slot. This arrangement provides a desired upward inclination for the bottom portion of the stand.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 5:
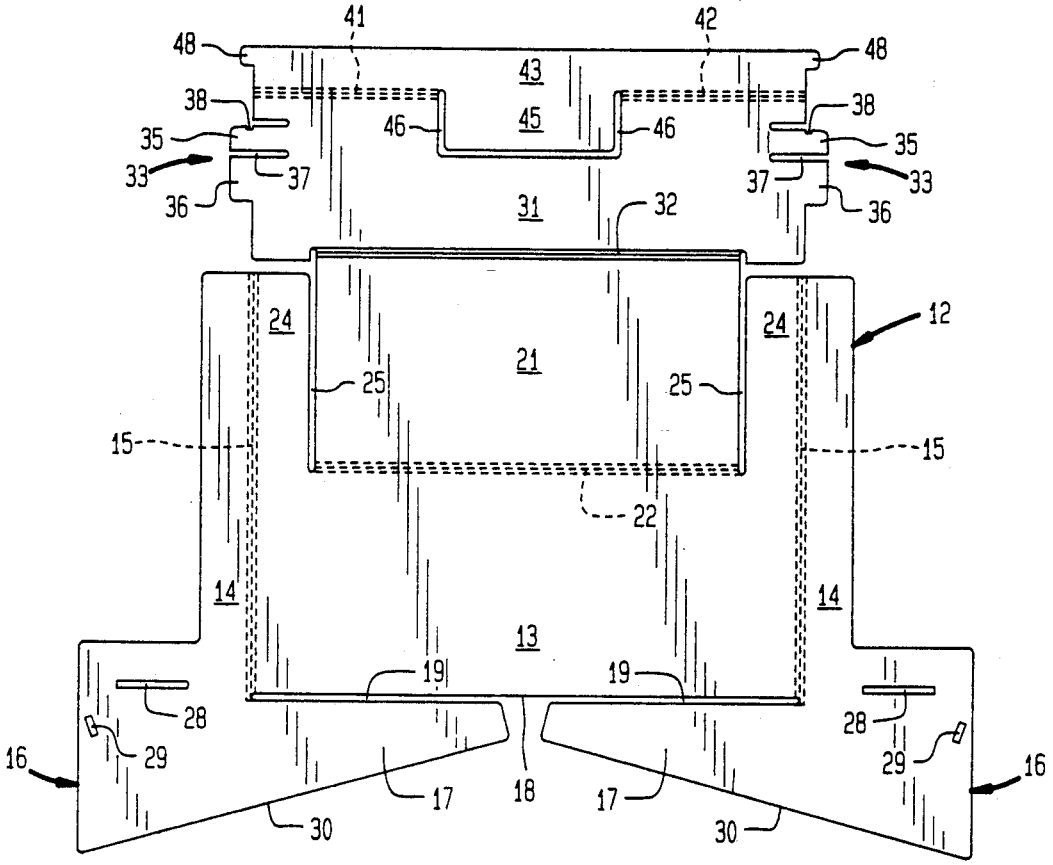
FIG. 5 is a plan view of a unitary sheet used to form the stand shown in FIG. 1.

A collapsible stand 11 shown in FIGS. 1–4 is formed from a unitary, single sheet 12 (FIG. 5) of preferably integrally molded plastic material. Included in the sheet 12 is a central portion 13 having lateral edges joined to wing portions 14 along bendable joints 15. A leg portion 16 extends downwardly from a bottom edge of each wing portion 14. Each leg portion has an elongated extension 17 disposed below a bottom edge 18 of the central portion 13 and separated therefrom by a slot 19. Defined by each leg portion 16 is an elongated receptacle slot 28 oriented at a slight angle to its rectilinear bottom edge 30. Also defined by each leg 16 is a substantially vertical second slot 19 disposed adjacent to its outer edge. A connecting portion 21 projects upwardly from the central portion 13 along a bendable joint 22. Also included in the central portion 13 are a pair of laterally disposed upward projections 24 separated from the connecting portion 21 by slots 25 and joined to the wing portions 14 along the bendable joints 15.

A bottom portion 31 projects upwardly from an upper edge of the connector portion 21 and is joined thereto along a bendable joint 32. Extending laterally from each side of the bottom portion 31 is an insert portion 33. Each insert portion 33 includes an upper tab 35 and a lower tab 36 separated by a slot 37. Formed on an upper edge of each upper tab 35 is a notch 38.

Joined to an upper edge of the bottom portion 31 along a pair of laterally spaced apart bendable joints 41, 42 is waist portion 43. A front stop portion 45 extends downwardly from a central portion of the waist portion 43 between the bendable joints 41, 42 and is separated from the connector portion 31 by slots 46. Extending laterally from opposite ends of the waste portion 43 are a pair of waist tabs 48. Preferably, each of the bendable joints 15, 22, 32, 41 and 42 is created by a groove molded in the sheet 12.

ASSEMBLY

Figure 2:
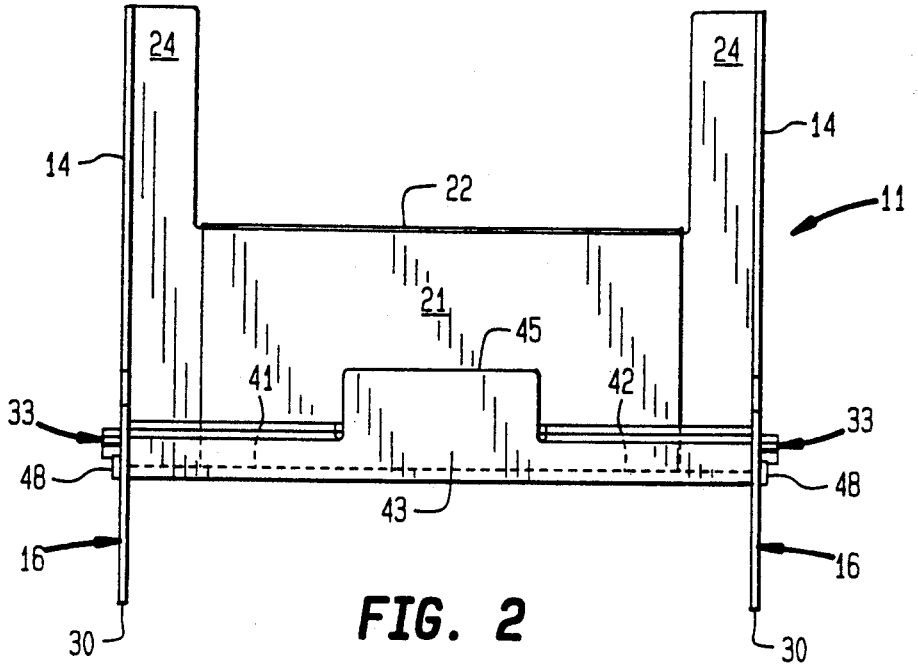
FIG. 2 is a front view of the stand shown in FIG. 1.
Figure 4:
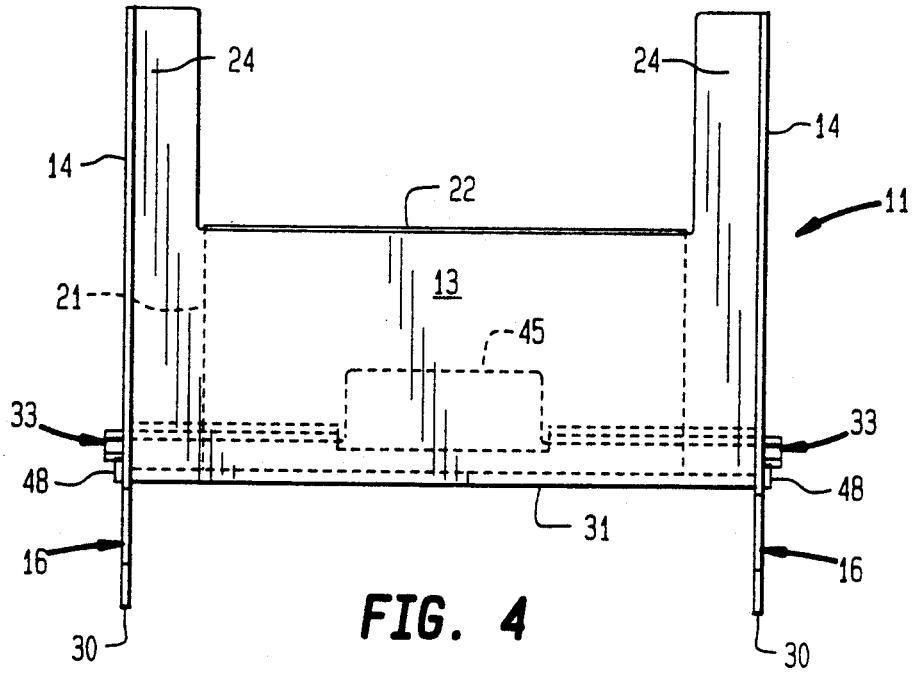
FIG. 4 is a rear view of the stand shown in FIG. 1.

During assembly of the collapsible stand 11, each of the wing portions 14 is bent forwardly along the joints 15 into positions substantially perpendicular to the central portion 13 as shown in FIG. 2.

Figure 1:
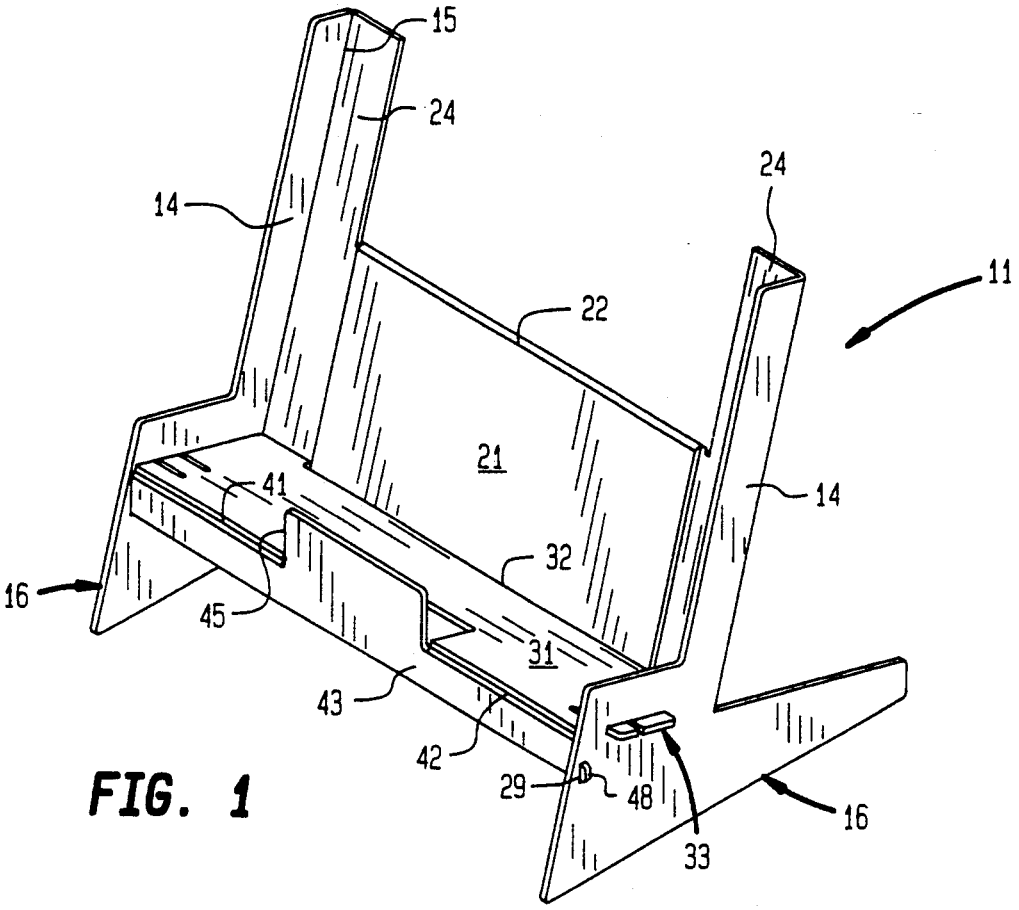
FIG. 1 is a perspective view of a collapsible stand.
Figure 3:
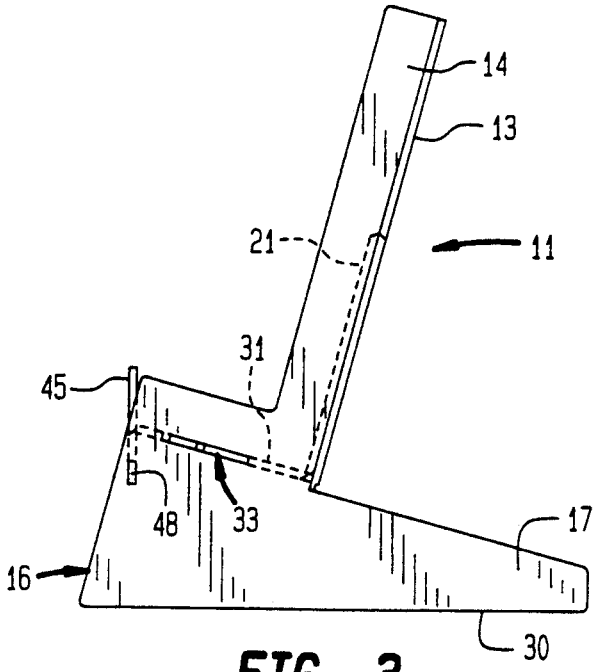
FIG. 3 is a side view of the stand shown in FIG. 1.

During assembly of the collapsible stand 11, the connector portion 21, the bottom portion 31, the waist portion 43 and the front stop portion 45 together are bent downwardly along the joint 22 to engage the central and connector portions 13, 21 in a parallel relationship. Next, the bottom portion 31 is bent outwardly along the joint 32 into a position transverse to the central portion 13 as shown in FIG. 1. The waist portion 43 then is bent downwardly along the joints 41, 42 into a position transverse to the outwardly projecting bottom portion 31. That movement of the waist portion 43 moves the front stop portion 45 into a position transverse to and above the bottom portion 31 as also shown in FIG. 1. Finally, all portions of the stand 11 are secured into their assembled positions by insertion of the insert tabs 35, 36 into the elongated receptacle slots 28 in the leg portions 16 and insertion of the waist tabs 48 on the waist portion 43 into the second slots 29 in the leg portions 16. The combined width of the insert tabs 35, 36 is greater than the length of the receptacle slots 28. Therefore, insertion of the tabs 35, 36 requires their contraction along the slots 37. After suitable positioning of each insert portion 33 into a receptacle slot 28, the flexible upper tab 35 thereof springs outwardly producing engagement between the notch 38 and an edge portion of the slot 28.

Because of the angled relationship existing between the elongated slots 28 and the rectilinear bottom edges 30 of the legs 16, insertion of the tabs 33 produces relative orientations of the sheet portions such that the bottom portion 31 is inclined from the central portion 13 upwardly relative to the rectilinear bottom edges 30 as shown in FIG. 1. After positioning of the bottom edges 30 of the legs 16 on a surface such as the ground, the central portion 13, the wing portions 14, the projections 24 and the front stop portion 45 form a cradle for receiving a radio control transmitter (not shown). The above described inclination of the bottom portion 31 results in a slightly rearward inclination of a transmitter so as to facilitate utilization of its controls. In addition, the retained radio transmitter is maintained by the assembled stand 11 in a position above the ground surface on which the stand rests, thereby isolating the transmitter from dirt and moisture.

Obviously, many modifications and variations of the present invention are possible in light of the above teachings. It is to be understood, therefore, that the invention can be practiced otherwise than as specifically described.

What is claimed is:

1. A collapsible stand comprising:

a unitary sheet having a central portion; a pair of wing portions, one joined to each lateral edge of said central portion at a bendable joint; a pair of leg portions, one joined to a bottom edge of each wing portion and extending downwardly below a bottom edge of said central portion; a connecting portion extending upwardly from said central portion and joined thereto at a bendable joint; and a bottom portion joined to an upper edge of said connecting portion at a bendable joint; and wherein said bottom portion defines a pair of oppositely directed laterally projecting insert portions; and each of said leg portions defines a receptacle disposed to receive one of said insert portions with said wing portions bent forwardly into positions substantially perpendicular to said central portion, said connecting portion bent downwardly into a position substantially parallel to said central portion, and said bottom portion bent forwardly into a position extending transversely to said central portion.

2. A stand according to claim 1 wherein each said leg portion includes an extension disposed below said central portion and separated from said bottom edge thereof by a slot.

3. A stand according to claim 1 wherein with said insert portions received by said receptacles, said bottom portion is inclined with respect to bottom edges of said leg portions upwardly from said central portion.

4. A stand according to claim 1 wherein said unitary sheet further includes a waist portion joined to an upper edge of said bottom portion at a bendable joint and having laterally projecting waist tabs, and each said leg portion further defines an opening disposed to receive one of said waist tabs with said inserts received by said receptacles and said waist portion bent downwardly into a position transverse to said bottom portion.

5. A stand according to claim 4 wherein said unitary sheet further includes a front stop portion projecting downwardly from said waist portion and separated from said bottom portion by slot means.

6. A stand according to claim 1 wherein said central portion includes a pair of laterally disposed projections extending upwardly from joints between said central portion and said connecting portion, each said projection being separated from said connecting portion by a slot and joined to one of said wing portions by a bendable joint.

7. A stand according to claim 1 wherein said unitary sheet is an integrally molded plastic sheet.

8. A stand according to claim 7 wherein each said bendable joint is a scored joint.

9. A stand according to claim 1 wherein each said receptacle is an elongated slot, and each said insert comprises a pair of laterally projecting spaced apart tabs.

10. A stand according to claim 9 wherein each said leg portion has a bottom edge for engaging a supporting surface and said elongated slot in each said leg is disposed at an angle to said bottom edge thereof.

11. A stand according to claim 10 wherein said unitary sheet is an integrally molded plastic sheet.

12. A stand according to claim 11 wherein each said bendable joint is a scored joint.

13. A stand according to claim 12 wherein each said leg portion includes an extension disposed below said central portion and separated from said bottom edge thereof by a slot.

14. A stand according to claim 13 wherein with said insert portions received by said openings, said bottom portion is inclined with respect to bottom edges of said leg portions upwardly from said central portion.

15. A stand according to claim 14 wherein said unitary sheet further includes a waist portion joined to an upper edge of said bottom portion at a bendable joint and having laterally projecting waist tabs, and each said leg portion further defines an opening disposed to receive one of said waist tabs with said inserts received by said receptacles and said waist portion bent downwardly into a position transverse to said bottom portion.

16. A stand according to claim 15 wherein said unitary sheet further includes a front stop portion projecting downwardly from said waist portion and separated from said bottom portion by slot means.

17. A stand according to claim 16 wherein said central portion includes a pair of laterally disposed projections extending upwardly from joints between said central portion and said connecting portion, each said projection being separated from said connecting portion by a slot and joined to one of said wing portions by a bendable joint.

18. A stand according to claim 12 wherein said unitary sheet further includes a waist portion joined to an upper edge of said bottom portion at a bendable joint and having laterally projecting waist tabs, and each said leg portion further defines an opening disposed to receive one of said waist tabs with said inserts received by said receptacles and said waist portion bent downwardly into a position transverse to said bottom portion.

19. A stand according to claim 12 wherein said unitary sheet further includes a front stop portion projecting downwardly from said waist portion and separated from said bottom portion by slot means.

20. A stand according to claim 12 wherein said central portion includes a pair of laterally disposed projections extending upwardly from joints between said central portion and said connecting portion, each said projection being separated from said connecting portion by a slot and joined to one of said wing portions by a bendable joint.

* * * * *